United States Patent [19]

Farber

[11] Patent Number: 4,887,720

[45] Date of Patent: Dec. 19, 1989

[54] PACKAGE FOR LIQUID MATERIALS

[75] Inventor: Jurgen Farber, Am Hageldreuz, Fed. Rep. of Germany

[73] Assignee: PKL Verpackungssysteme GmbH, Dusseldorf, Fed. Rep. of Germany

[21] Appl. No.: 773,391

[22] Filed: Sep. 6, 1985

Related U.S. Application Data

[63] Continuation-in-part of Ser. No. 307,254, Sep. 30, 1981.

[30] Foreign Application Priority Data

Oct. 1, 1980 [DE] Fed. Rep. of Germany ..... 3037072

[51] Int. Cl.[4] ..... B65D 5/72

[52] U.S. Cl. ..... 206/621.2; 206/621.1; 229/125.42

[58] Field of Search ..... 229/7 R, 7 S, 7 SC, 229/17 R, 17 G

[56] References Cited

U.S. PATENT DOCUMENTS

| | | | |
|---|---|---|---|
| 2,382,597 | 4/1945 | Amberg | 229/7.5 |
| 3,178,089 | 4/1965 | Tobias et al. | 229/17 G |
| 3,178,091 | 4/1965 | Tobias et al. | 229/17 G |
| 3,189,246 | 6/1965 | Seline, Jr. | 229/17 G |
| 3,297,227 | 1/1967 | Wallsten | 229/17 G |
| 3,325,076 | 6/1967 | Souey | 229/7 S |
| 3,596,829 | 8/1971 | Gardner | 229/7 S |
| 3,770,185 | 11/1973 | Reeves | 229/17 G |

FOREIGN PATENT DOCUMENTS

| | | | |
|---|---|---|---|
| 807640 | 7/1951 | Fed. Rep. of Germany | 229/7 S |
| 1486438 | 7/1969 | Fed. Rep. of Germany . | |
| 1109242 | 4/1968 | United Kingdom | 229/17 G |
| 2048220 | 12/1980 | United Kingdom | 229/17 G |

*Primary Examiner*—David T. Fidei

*Attorney, Agent, or Firm*—Sprung Horn Kramer & Woods

[57] ABSTRACT

A plastic-coated cardboard blank for forming a container of rectangular cross-section having a gabled top, the blank comprising four walls, a first pair of opposite walls each having fold lines forming an upwardly convergent triangle having its apex some distance below the top of its respective wall, the second pair of opposite walls being adapted to be joined to one another at their tops to form the gable, one of the first pair of walls having a cut-out in its top above its respective apex, whereby upon erecting the blank and joining the tops of the second pair of walls the resulting gable closes off the cut-out but upon opening the gable the cut-out is uncovered for insertion of a straw therethrough into the interior of the container.

3 Claims, 1 Drawing Sheet

PACKAGE FOR LIQUID MATERIALS

CROSS-REFERENCE TO RELATED APPLICATION

This is a continuation-in-part of Application Ser. No. 307,254, filed Sept. 30, 1981.

BACKGROUND OF THE INVENTION

1. Field of the Invention

The invention concerns a package for liquid materials that is made of plastic-coated cardboard folded and bonded into a hollow shape consisting of a roughly triangular prism on a cubical base, the package having a point at which a drinking straw can be introduced.

2. Description of Related Art

There are basically only two methods of providing a punched or stamped opening on a package for liquid materials at a point through which a drinking straw can be introduced. Each of these methods however depends on a supplementary manufacturing process.

The first method involves cutting or stamping an opening in the cardboard and then coating it on one or both sides to seal it until it is punctured with a drinking straw. This method is not possible however when the cardboard blank out of which the package is folded together is already coated with plastic. There remains of course the second possibility of stamping the cardboard with just enough force at the point at which the straw is to be introduced to weaken it so that the straw can perforate it readily. This approach is however very difficult. The die can not be allowed to penetrate the cardboard to the slightest degree because even the smallest opening would allow air to enter and liquid to escape. Avoiding this problem by sealing the perforated or stamped point with a strip of adhesive material is of course known, but this measure also involves problems. Gluing or bonding the strip onto the package requires an additional manufacturing stage. The strip may come off too easily or even not provide a tight seal. If, on the other hand, the point has not been stamped deeply enough, it can not be perforated with the straw, which will bend and become unusable, as happens frequently.

SUMMARY OF THE INVENTION

The purpose of the present invention is to avoid these disadvantages and provide a simple method of making an opening, which will not only remain reliably sealed until intentionally opened but will then be easy to open to permit the introduction of a straw, a method that will be an integral part of manufacturing the blank out of which the package is folded and bonded.

This purpose is accomplished by providing a cut-out or cut-away in the blank, in the flap at the apex of the triangular area that will form one end of the prism when the package has been folded together. Such a cut-out will preferably be semicircular and its diameter will be long enough for the straw to be inserted through it. The flap at the apex of the triangular area is wide enough to completely cover the cut-out when the package is folded together and bonded.

The first advantage of the invention is that no special or additional means beyond those needed to produce the blank itself are required to manufacture the opening, which is in fact manufactured as an integral part of the process used to manufacture the blank. The second advantage is that bonding the flap to the package ensures a dependable seal. Finally, the opening will automatically uncover when the bonded seam is removed, so that all the previously necessary and troublesome manipulation is unnecessary.

BRIEF DESCRIPTION OF THE DRAWING

The invention will now be described in greater detail with reference to the embodiment illustrated in the drawing, in which FIG. 1 is a front view and FIG. 2 a top view of the folded package, while

DESCRIPTION OF PREFERRED EMBODIMENT

Figure 1:
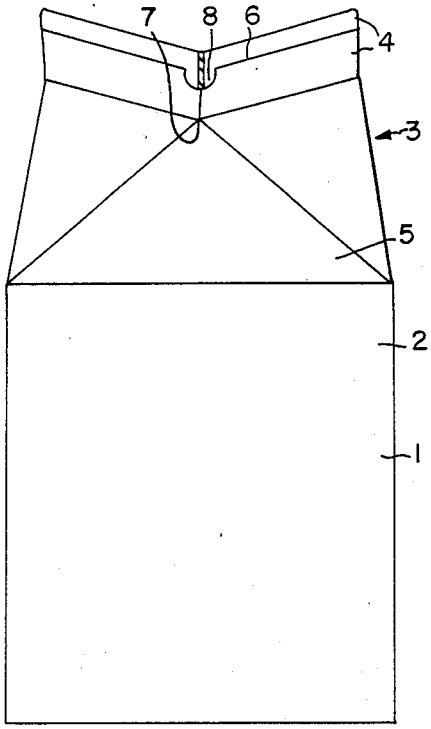

The package 1 for liquid materials is made of a blank of plastic-coated cardboard that is folded into a hollow shape consisting of a roughly triangular prism 3 resting on a cubical base 2 and with a flush bonded seam 4. The prism section of package 1 is not folded closed until the package has been filled. After the package is filled, the prism section is folded together and sealed at the top with seam 4. The triangular ends 5 of the prism are simultaneously creased inward. A cut-out 8 to permit access for a drinking straw is stamped out of a flap 6 at the apex 7 of the triangular area 5 that will form one end of the prism.

Figure 2:
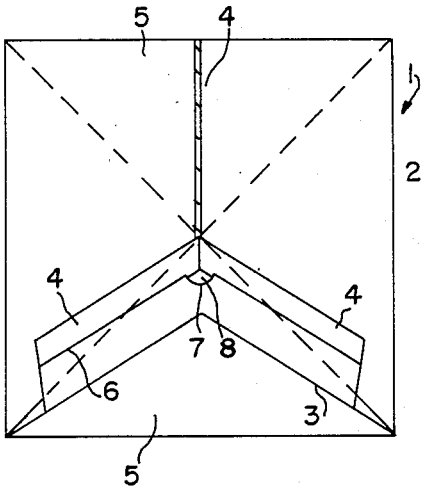

When the package is closed by bonding flap 6 with seam 4 along the top edge of the prism, cut-out 8 is reliably sealed shut. When seam 6 is stripped from the correct end of the prism, cut-out 8 will open automatically, as is obvious from FIGS. 1 and 2.

Although the cut-out in the illustrated embodiment is semicircular, other shapes are also possible.

Figure 3:
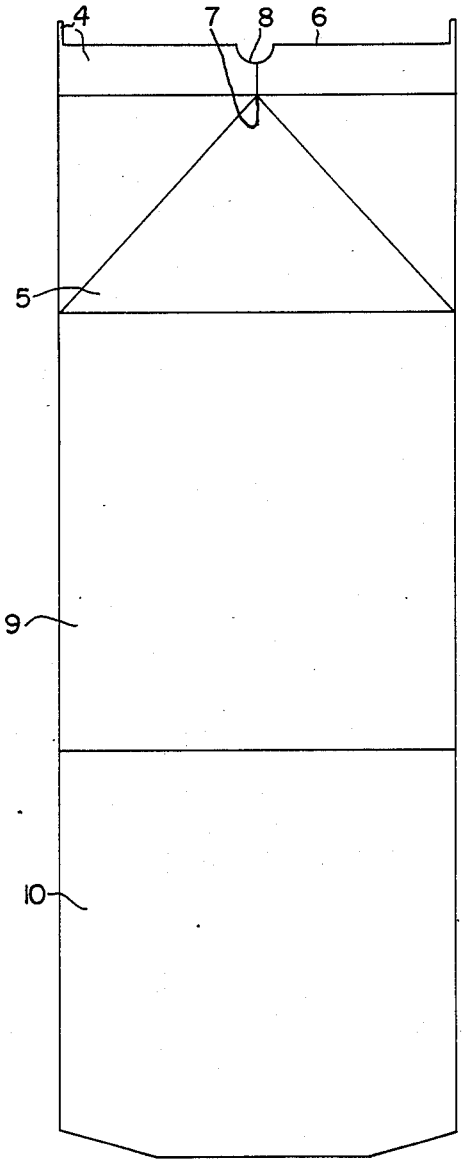
FIG. 3 shows the part of the blank that contains the notch.

The part of the blank shown in FIG. 3 has not only a triangular area 5, which will form the end of the prism section, and a square area 9 that will form one side wall of the cubical section, but also a square section that will fold up at a right angle to form the bottom of package 1. All the seams in the finished package are sealed liquid-tight by cement or heat bonding.

It is understood that the specification and examples are illustrative but not limitative of the present invention and that other embodiments within the spirit and scope of the invention will suggest themselves to those skilled in the art.

I claim:

1. A plastic-coated cardboard blank for forming a container of rectangular cross-section having a gabled top, the blank comprising four walls, a first pair of opposite walls each having fold lines forming an upwardly convergent triangle having its apex some distance below the top of its respective wall, the second pair of opposite walls being adapted to be joined to one another at their tops to form the gable, one of the first pair of walls having a cut-out at its top above its respective apex and only in its immediate vicinity, the cut-out being of the approximate area of the cross-section of a straw, whereby upon erecting the blank and joining the tops of the second pair of walls the resulting gable closes off the cut-out but upon opening the gable without tearing of the wall the cut-out is uncovered for insertion of a straw therethrough into the interior of the container.

2. A blank according to claim 1, wherein the second pair of opposite walls across their tops are bondable to one another, except in the immediate vicinity of the cut-out.

3. A container erected from a blank according to claim 1.

* * * * *